US006694851B2

(12) United States Patent
Erisoty

(10) Patent No.: US 6,694,851 B2
(45) Date of Patent: Feb. 24, 2004

(54) MULTI-ANGLE MITER BOX WITH CLAMPING FEATURE

(76) Inventor: James S. Erisoty, 111 Cherry Brook Rd., Canton Center, CT (US) 06020

( * ) Notice: Subject to any disclaimer, the term of this patent is extended or adjusted under 35 U.S.C. 154(b) by 37 days.

(21) Appl. No.: 09/813,180

(22) Filed: Mar. 20, 2001

(65) Prior Publication Data

US 2002/0029678 A1 Mar. 14, 2002

Related U.S. Application Data

(60) Provisional application No. 60/192,913, filed on Mar. 29, 2000.

(51) Int. Cl.[7] ..... B27B 21/00; B27G 5/02

(52) U.S. Cl. ..... 83/767; 83/457; 83/466; 269/235; 269/305

(58) Field of Search ..... 83/462, 463, 464, 83/465, 466, 762, 763, 764, 765, 766, 767, 452, 457, 458, 468.3, 761; 269/212, 215, 141, 165, 194, 195, 207, 213, 214, 231, 235, 236, 305; D8/71

(56) References Cited

U.S. PATENT DOCUMENTS

| | | | | | |
|---|---|---|---|---|---|
| 346,240 | A | | 7/1886 | Soukup | 83/763 |
| 391,093 | A | * | 10/1888 | Sloat | 83/767 |
| 401,423 | A | | 4/1889 | Englehard | 83/763 |
| 409,295 | A | * | 8/1889 | Loring | 269/215 |
| 415,637 | A | * | 11/1889 | Haueisen et al. | 83/458 X |
| 477,233 | A | | 6/1892 | Soukup | 83/767 |
| 701,167 | A | * | 5/1902 | Dennis | 269/212 X |
| 737,322 | A | | 8/1903 | Birge | 83/767 |
| 937,946 | A | * | 10/1909 | Lithander | 83/765 |
| 1,063,113 | A | | 5/1913 | Bremer | 83/760 |
| 1,381,854 | A | * | 6/1921 | Wilson | 269/194 |
| 5,259,284 | A | | 11/1993 | Chen | 83/468.3 |
| 5,573,230 | A | * | 11/1996 | Lambertini | 269/235 |
| D406,035 | S | | 2/1999 | Erisoty et al. | D8/71 |

* cited by examiner

*Primary Examiner*—Clark F. Dexter
(74) *Attorney, Agent, or Firm*—Ira S. Dorman

(57) ABSTRACT

A miter box is comprised of two incomplex components, namely, a base and a U-shaped guide member, which are assembled by engagement of a pivot post on the guide member within a passage extending normal to the surface of the table of the base. An assembly for clamping the workpiece against a fence member on the base consists of a lug that is engageable at each of numerous locations along the length of a channel for location proximate the fence, and a clamping piece that is rotatably mounted on the lug piece for being turned into clamping engagement with the workpiece.

9 Claims, 3 Drawing Sheets

MULTI-ANGLE MITER BOX WITH CLAMPING FEATURE

CROSS-REFERENCE TO RELATED APPLICATION

This application claims the benefit of Provisional Application No. 60/192,913, filed Mar. 29, 2000, bearing the title hereof and designating the same inventor.

BACKGROUND OF THE INVENTION

Miter boxes known in the art and offered commercially tend to be of relatively complex and expensive construction. To the extent that low-cost miter boxes are available, moreover, they often permit cutting at only a limited number of fixed angular positions, such as 22.5°, 45°, and 90°; it is of course commonly necessary to cut at angles other than those that may be established, and the limited capability such miter boxes therefore represents a serious deficiency. Low-cost miter boxes also generally lack a convenient and/or simple clamping arrangement, and may require the user to hold the workpiece manually during the cutting operation.

Representative of the prior art in the filed of the invention is Englehard U.S. Pat. No. 401,423 and Soukup U.S. Pat. No. 477,233, each of which provides a miter box that enables cutting throughout a range of angles. Erisoty et al. U.S. Pat. Des. No. 406,035 provides a low-cost miter box having a locking mechanism for securing the workpiece.

SUMMARY OF THE INVENTION

A need remains for a miter box that is of relatively incomplex design, inexpensive manufacture, and convenient to use, and that nevertheless enables cutting at virtually any angle, and it is a broad object of the present invention to provide such a miter box.

More specific objects of the invention are to provide such a miter box comprised of a minimal number of readily assembled and disassembled components, and that lends itself to manufacture, at least in significant part, from a synthetic resinous material using conventional molding techniques.

A further specific object of the invention is to provide such a miter box having an integrated clamping arrangement that is capable of easily and effectively securing workpieces of a wide range of thicknesses.

It has now been found that at least certain of the foregoing and related objects of the invention are attained by the provision of a miter box adapted for use for making cuts at each of a multiplicity of angles, and including a base and a generally U-shaped saw guide assembled therewith. The base is comprised of a table having a generally planar upper surface, an effectively circular passage extending on a axis normal to the upper surface of the table, and a forward edge portion on the table spaced from the passage; means is provided for supporting the table in an elevated position. The saw guide is comprised of a beam or arm, an upstanding pivot post adjacent the rearward end of the beam and pivotably engaged in the passage of the base, and an upstanding guide piece adjacent the forward end of the table; at least a portion of the length of the pivot post is of circular cross section to enable such pivotable engagement. The beam extends radially, in the space beneath the table, and is of such length as to dispose the guide piece adjacent the forward edge portion of the table. Both the pivot post and also the guide piece are slotted for cooperatively receiving the blade of a saw for reciprocal and longitudinal movement, and pivoting of the saw guide enables a saw so mounted to be aligned on any radius (within the range of movement) extending from the axis of the base passage.

In most embodiments the forward edge portion of the miter box table will be arcuate, and formed to extend circumferentially and concentrically with the circular passage. Indicia will usually be provided to afford visual references for selective angular positioning of the saw guide (and of course a mounted saw), relative to the base; such indicia may be printed on the surface and/or may constitute radial depressions formed into the surface to accommodate the cutting edge of the saw blade.

A member mounted on the saw guide and movable between positions of fixed engagement with and disengagement from the table may be provided for securing the saw guide in selected angular positions, such a securing member typically being of elongate form and mounted for movement (such as by threaded interengagement) on its longitudinal axis. The tip on one end of the securing member will generally be disposed to engage fixedly the forward edge portion of the table, and the securing member will desirably be oriented with a slight incline, in the direction of the table, so as to avoid interference with movement of a mounted saw. A plurality of discrete locking elements may be disposed at angularly spaced locations along the forward edge portion of the table, each coacting with the securing member for affixing the saw guide at a selected angular position.

The base of the miter box will normally include an upstanding fence member having portions disposed substantially diametrically to opposite sides of the circular passage through the base, thereby to provide a back supporting surface having elements in a plane substantially perpendicular to the plane in which the upper surface of the table lies. In such embodiments the pivot post will desirably be cylindrical along at least most of its length, with the fence member portions defining effectively a cylindrical bore which provides, at least in part, the passage in which the post is pivotably received and engaged.

The miter box will most desirably incorporate means for clamping a workpiece against the fence member. Such means will preferably define at least a first channel recessed into the upper surface of the table, a lug piece dimensioned and configured to seat in the channel at each of a multiplicity of locations along its length, and a clamping piece mounted on the lug piece for rotation about an axis normal to the plane of the upper surface of the table. The channel has a proximal end near the fence member and a remote distal end, and it is defined by shaped opposite sidewalls which substantially replicate one another and are characterized by a multiplicity of substantially identical structural elements spaced regularly along its length and projecting inwardly toward its center line. The opposite lateral surfaces of the lug piece are formed with structural features for matingly engaging the sidewalls of the channel and effectively locking it against displacement therealong. At least one lobe portion projects from the clamping piece, and has a bearing surface disposed for being brought, by rotation of the clamping piece, into clamping engagement with a workpiece supported against the back supporting surface of the fence member when the lug piece is seated in the channel at a proximate location.

In certain embodiments the structural elements of the channel-defining sidewalls will be symmetrical about centerlines through their apices, and the elements of one of the sidewalls will be offset, along the length of the channel, from the like structural elements of the other sidewall by a distance that is less than the pitch distance between adjacent apices (typically, half the distance); the mating structural features on the opposite lateral surfaces of the cooperating lug piece will have effectively the same relative offset. Such construction permits the lug piece to engagingly seat in the channel in end-for-end inverted orientations, with the position of the lug piece thereby being shifted somewhat along the length of the channel.

The clamping piece will also advantageously have two opposite ends, each providing a lobe portion with a bearing surface thereon, the clamping piece and lug piece having means for coupling them for relative rotation about an axis that is eccentric to a midpoint between the bearing surfaces. The means for coupling will conveniently comprise a pin projecting from one of the pieces into an aperture formed in the other piece, the aperture being dimensioned to receive the pin, desirably in snug interengagement, and the pin and/or the aperture being disposed on the eccentric axis of the clamping piece.

The channel formed into the table surface will usually extend along a substantially rectilinear axis, which axis will desirably be generally normal to the plane of the back supporting surface of the fence member. The sidewalls of the channel will typically be of scalloped or undulant, sawtooth, or square tooth character. In most instances the channel-defining means will define a second such channel, with an additional lug piece and an additional clamping piece being provided for functioning cooperatively with one another in the manner described. The two channels will normally be spaced laterally from one another to opposite sides of the axis of the circular passage through the base, and the portion of the table lying forwardly of the circular passage will usually be substantially semicircular.

DETAILED DESCRIPTION OF THE PREFERRED AND ILLUSTRATED EMBODIMENTS

Figure 1:
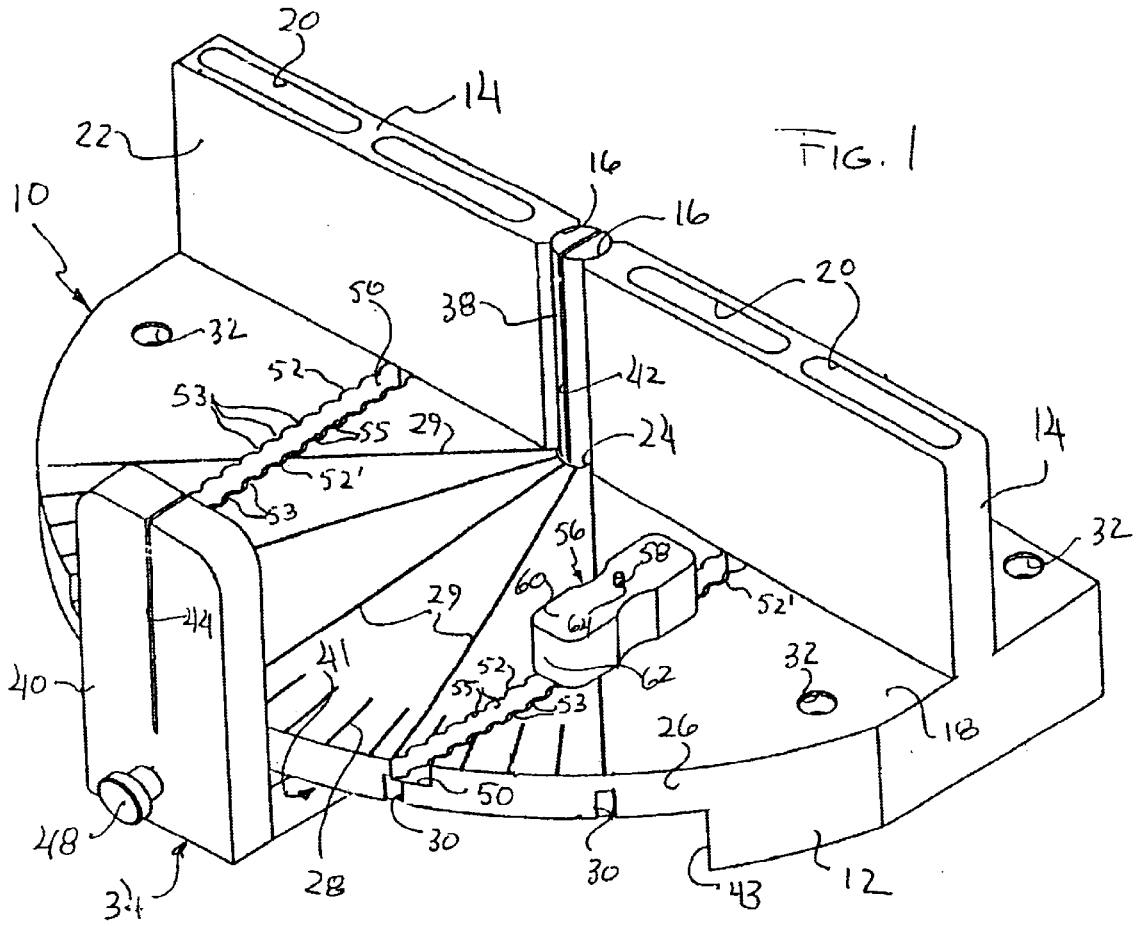
FIG. 1 is perspective view of a miter box embodying the present invention.
Figure 3:
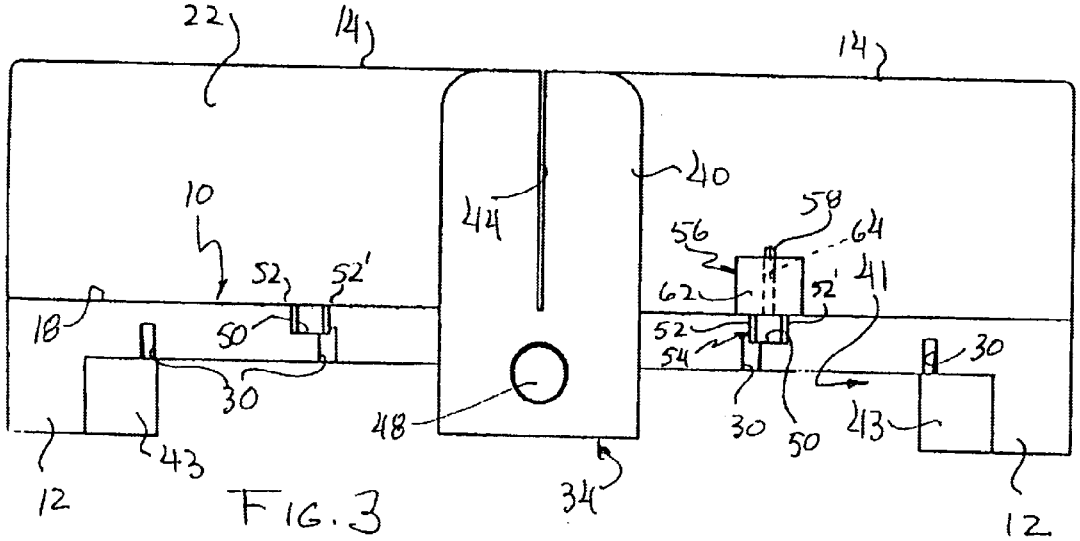
FIG. 3 is a front elevational view of the miter box.

Turning now in detail to the appended drawings, therein illustrated is a miter box embodying the present invention and consisting of a base having a generally semicircular table portion, generally designated by the numeral 10, supported in an elevated position by a pair of foot portions 12 disposed along opposite lateral margins of the table portion 10. A fence portion, comprised of a pair of aligned upright panels 14, extends diametrically across the table. The portions 14 are formed with substantially semicircular facing edges 16, which define the opposite sides of an effectively cylindrical passage having an axis normal to the upper surface 18 of the table portion 10, and deep slots 20 extend downwardly into the panels 14 to provide receptacles for conveniently holding small implements, tools, pencils, and the like. The panel portions 14 cooperatively provide a planar back supporting fence surface 22, which lies perpendicular to the upper surface 18 of the table portion 10.

A circular hole 24 is formed through the table portion 10 as an extension of the passage defined by the panel edge surfaces 16, and the axis of the passage constitutes the center point for the arcuate forward edge 26 of the table portion. An angle scale 28 of radial reference marks is formed on the upper surface 18 of the table 10, with the more common cutting angles being designated by lines (which are desirably shallow grooves formed into the surface 18) that extend fully between the hole 24 and the forward edge 26, and being marked to indicate their angular values relative to a line perpendicular to the back support surface 22; positive locating notches or locking stops 30, associated with the common miter cuts, are also formed into the forward edge 26. Holes 32 extend through the margins of the table portion 10 and the foot portions 12 for receiving screws or other fasteners by which the base of the miter box may be semipermanently attached to a supporting surface.

Figure 5:
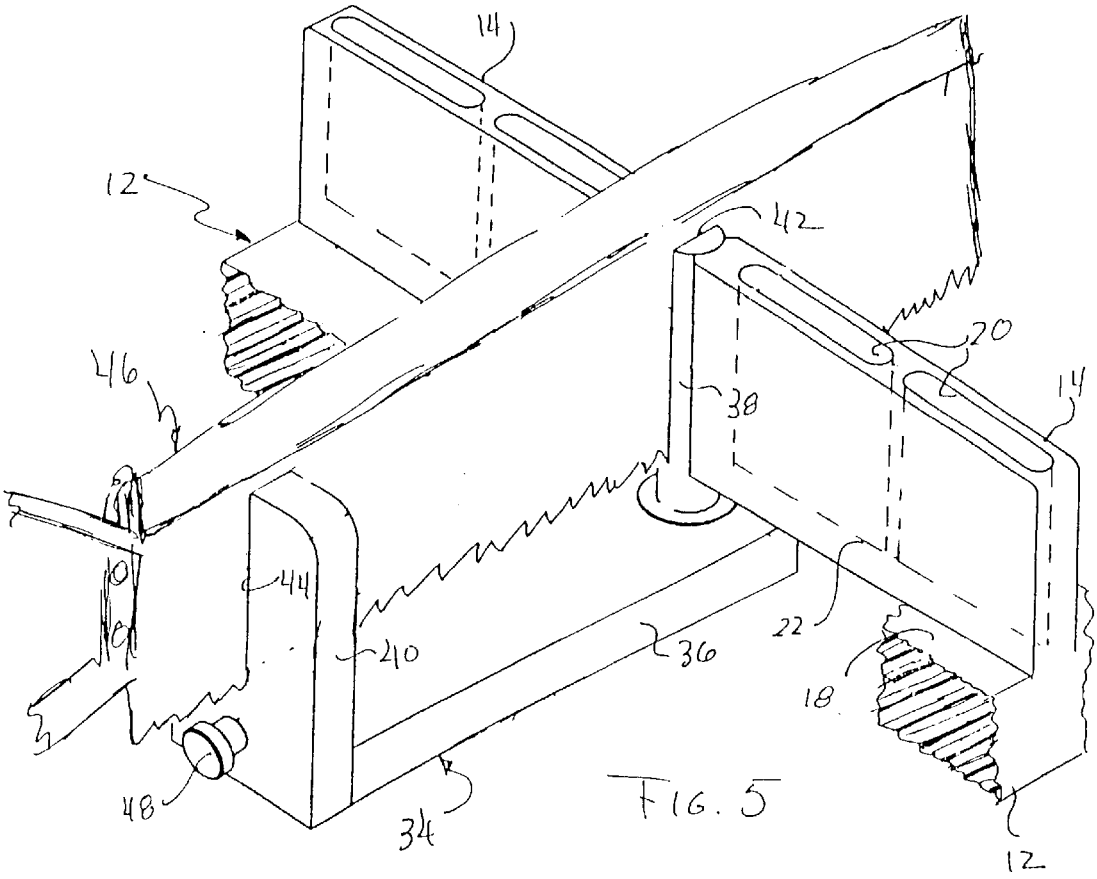
FIG. 5 is a perspective view of the miter box, showing the table and supporting foot portions broken away, and showing a fragmentarily illustrated saw assembled therewith.
Figure 6A:
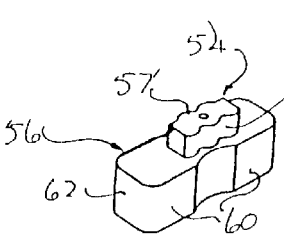
FIGS. 6A and 6B are, respectively, a perspective view of the clamping assembly utilized in the miter box, inverted from the position of normal operation, and a bottom plan view of the assembly.
Figure 6B:
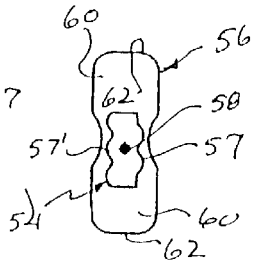

As is best seen in FIG. 5, a U-shaped guide member, generally designated by the numeral 34, is assembled with the base. It consists of a beam or arm 36, a cylindrical post 38 adjacent one end of the beam 36, and an upright guide piece or wall 40 adjacent the opposite end. The post 38 extends upwardly through the hole 24 in the table portion 10 (not seen in FIG. 5) and through the portion of the passage defined by the concave inner edges 16 of the fence panels 14. Because the thickness of the beam 36 is substantially equal to (or slightly less than) the height of the foot portions 12, the guide member 34 can rest upon the underlying supporting surface and still move freely within the space 41 defined beneath the table portion 10 between the foot portions 12, pivoting of course about the axis of the passage; the space 41 will desirably be of generally secantal character, with the inner surfaces 43 of the foot portions 12 defining the limits of arcuate travel of the guide member 34.

Both the post 38 and also the guide piece 40 are slotted, at 42 and 44 respectively, to receive a saw, generally designated by the numeral 46, and to permit its movement for normal cutting action. It is self-evident that the guide member can be rotated to any angular position throughout its range of movement, so as to bring the blade of the mounted saw into registry with any radius and thereby enable cutting of a workpiece with a miter of virtually any value. A knurl-headed locking pin 48 is threadably engaged (by means not shown) in an aperture formed through the guide piece 40, and is disposed to engage the surface of the arcuate edge 26 of the table portion 10 for affixing the guide member 34 in any selected position; the tip of the pin will engage within the notches 30 to locate principal positions.

It will be appreciated that the described components of the miter box can be of any suitable form and construction, and may constitute an assembly of separate parts made of wood, metal, etc. Economy and simplicity of manufacture will often be favored however by fabrication of the components from synthetic resinous materials utilizing conventional molding techniques, with each of the main components (i.e. the base and the guide member) often desirably being formed integrally and as one piece.

The incorporated workpiece clamping arrangement constitutes a further unique feature of the present miter box. In the embodiment illustrated, two parallel channels 50 are formed into the upper surface 18 of the table portion 10, each extending on a rectilinear axis that lies perpendicular to the plane of the fence surface 22; they are spaced equidistantly to the opposite sides of the hole 24, albeit other spacings (and indeed, the use of a single channel) are entirely feasible.

Figure 2:
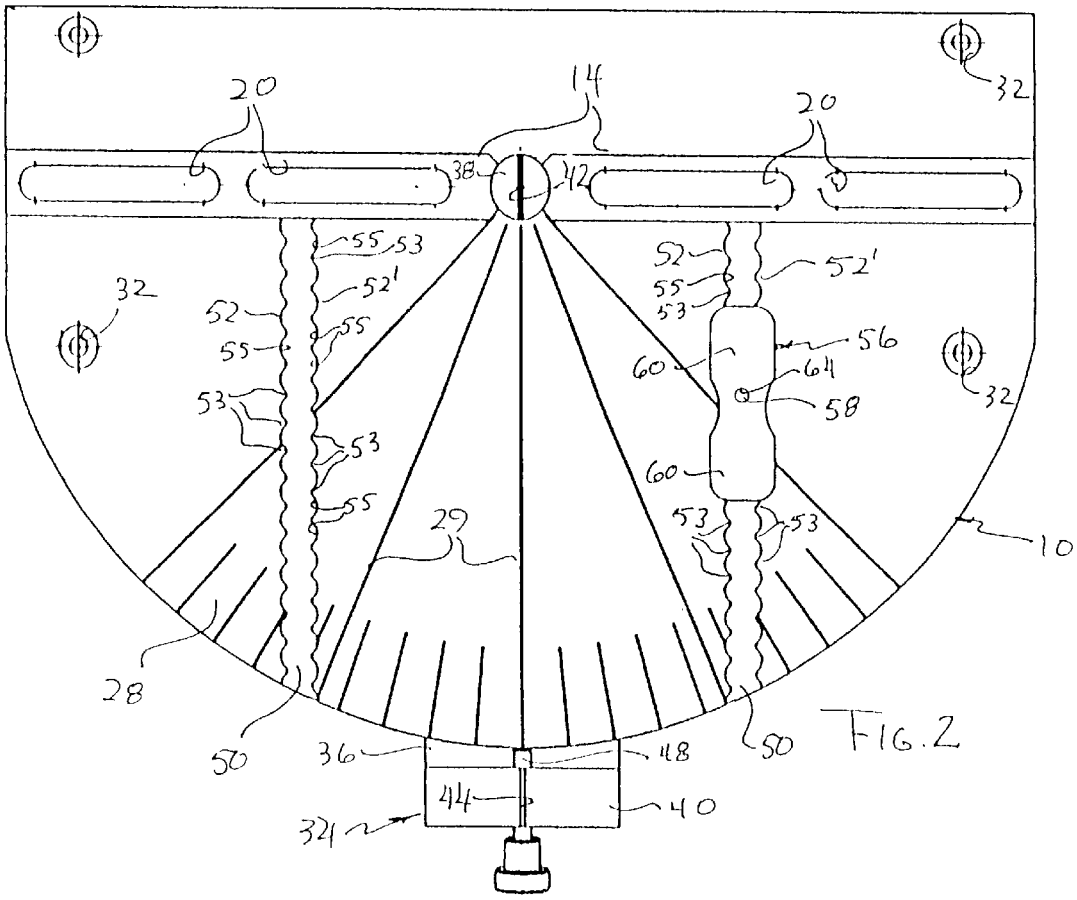
FIG. 2 is a top plan view of the miter box depicted in FIG. 1.
Figure 4:
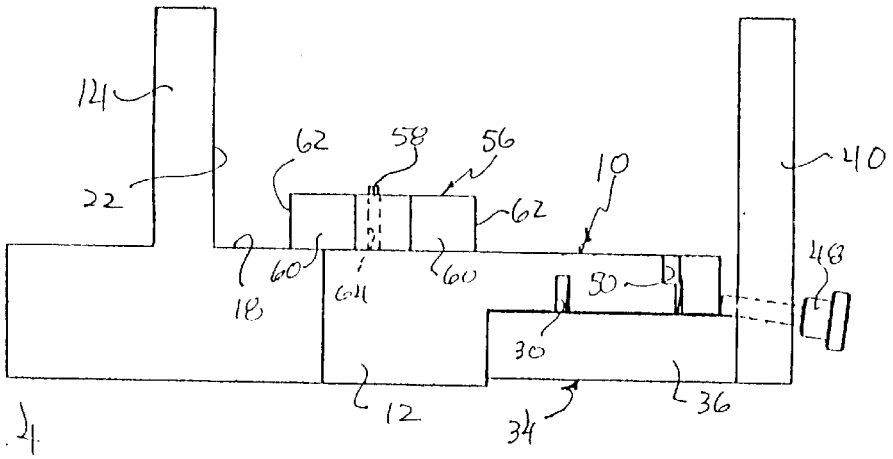
FIG. 4 is a side elevational view of the miter box.

As is perhaps best seen in FIG. 2, each channel 50 is defined by a pair of shaped margins or sidewalls 52, 52', which replicate one another and are characterized by being comprised of a multiplicity of substantially identical structural elements spaced regularly along the length of the channel. More particularly, the shaped margins of the depicted channels are of undulate or generally scalloped form. The crests of the projecting elements 53, and the intervening valleys 55, of the two margins 52 are however offset to lie half-way between the corresponding crests and valleys of the margin 52' (i.e., the structural features of the two margins may be regarded to be 180° out of phase with one another).

A clamping assembly consisting of a lug piece and a wing-like clamping piece, generally designated respectively by the numerals 54 and 56, is associated with each of the channels 50 (only one such assembly being shown however in the drawings). The lug piece 54 is formed with lateral edge surfaces 57, 57' that are configured to mate with the shaped marginal sidewalls 52, 52' of the channels 50 and comprise elements that are offset from one another in the manner described. A pivot pin 58 projects from the lug piece 54 at a point midway between its opposite ends.

The clamping piece 56 has lobe portions 60 at its opposite ends, the edge of each of which provides a bearing surface 62. A small aperture 64 is formed through the clamping piece 56 and is dimensioned to snugly receive the pivot pin 58 of the lug piece 54. As is best seen in FIG. 2, the aperture 64 is displaced from the center point of the clamping piece 56 (i.e., the point midway between the bearing surfaces 62), causing it to be eccentrically rotatable on the lug piece 54 and effectively causing one of its lobe portions to be longer than the other.

As is evident, the clamping assembly is employed by seating the lug piece 54 in one of the channels 50, at a suitable location along its length proximate to the surface of a workpiece (not shown) supported against the fence surface 22. Rotation of the clamping piece 56 will bring the bearing surface 62 at one or the other of its opposite ends into clamping engagement with the workpiece (or at least closely adjacent thereto). If contact is not established, however, or if it is found that the clamping force exerted is either inadequate or excessive, the assembly may be lifted from the channel and moved to a more effective position along the groove (normally being the next adjacent step).

To achieve an optimal clamping action, however, it may be desirable to reinsert the lug piece 54 into the channel in its end-for-end inverted orientation. Because of the mutual offset of the elements of the marginal portions 52, 52', and the corresponding offset of the elements of the lateral lug piece surfaces 57, 57', such inversion will shift the assembly by one-half of the pitch distance (in the particular embodiment described), thereby affording a high degree of control upon the clamping action and the level of force applied.

Figure 7A:
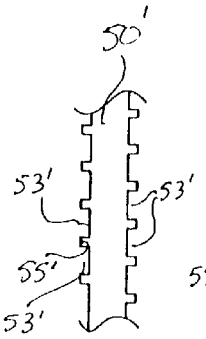
FIGS. 7A and 7B are fragmentary plan views of two alternative forms of channels comprising the clamping arrangement of the invention.
Figure 7B:
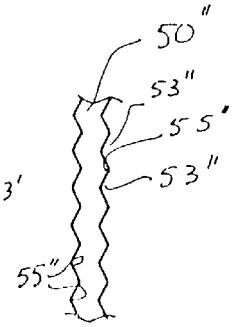

As suggested by FIGS. 7A and 7B, which show channels 50' and 50" comprised of marginal elements 53', 53", 55', and 55" to provide generally square-tooth and saw-tooth patterns, respectively, a wide variety of features may characterize the margins of the channels constituting the clamping arrangement; FIG. 7A additionally illustrates that teeth 53' and intervening gaps 55', need not be of equal width. It will be appreciated that the offset of the elements on the channel margins (and correspondingly, on the lug piece surfaces) may constitute any fraction of the pitch distance, and that the groove and the lug design need not employ an identical arrangement of protrusions and recesses; the space between adjacent protrusions on the lug piece may for example be large enough to accommodate two adjacent protrusions on the channel sidewall. If so desired, moreover, the pattern and form of the elements may be such as to limit seating of the lug piece in only one orientation, or to make inversion immaterial (i.e., where the opposite margins of the channel bear a mirror ventional molding techniques. In addition, the miter box provided incorporates a unique clamping arrangement that is capable of securing workpieces having a wide range of thicknesses, and that may indeed be utilized in a wide variety of apparatus, other than miter boxes image relationship to one another), in which instances the protruding elements (and intervening spaces) need not be of symmetric form (i.e., symmetric with respect to a centerline through the apex of the element, taken perpendicular to the longitudinal axis of the channel). Other variations in the components and elements of the instant miter box may of course occur to those skilled in the art, and may be adopted without departure from the concepts described and claimed herein.

Thus, it can be seen that the present invention provides a novel miter box that is relatively incomplex and inexpensive to manufacture and convenient to use, and that enables cutting at virtually any angle. The miter box is comprised of a minimal number of readily assembled and disassembled components, and it lends itself to manufacture, at least in significant part, from a synthetic resinous material using conventional molding techniques. In addition, the miter box provided incorporates a unique clamping arrangement that is capable of securing workpieces having a wide range of thicknesses, and that may indeed be utilized in a wide variety of apparatus, other than miter boxes.

Having thus described the invention, what is claimed is:

1. A miter box adapted for use with a saw for making cuts at each of a multiplicity of angles, comprising:

a base comprised of a table having a generally planar upper surface;

a saw guide assembled with said base and constructed for receiving the blade of a saw for cutting movement over said table upper surface, said saw guide being pivotable on an axis of pivoting relative to said base so as to enable the saw, mounted on said saw guide, to be aligned on each of a multiplicity of radii extending from said axis of pivoting;

an upstanding fence member providing a back supporting surface having elements defining a support plane substantially perpendicular to the plane in which said upper surface of said table lies; and means for clamping a workpiece against said fence member, said means for clamping comprising: channel-defining means defining at least a first channel recessed into said upper surface of said table and having a proximal end near said fence member and a distal end remote therefrom, said first channel being defined by shaped opposite sidewalls which substantially replicate one another and are characterized by a multiplicity of substantially identical structural elements spaced regularly along the length of said first channel and projecting toward a center line thereof; a first lug piece dimensioned and configured to engage and mate with said substantially identical structural elements by which said shaped opposite sidewalls of said first channel are characterized so as to seat in said first channel at each of a multiplicity of locations along the length thereof, said first lug piece having opposite ends and opposite lateral surfaces extending therebetween, said lateral surfaces being formed with fixed mating structural features that correspond to said structural elements of said shaped opposite sidewalls for engaging matingly said opposite sidewalls of said first channel when seated therein, thereby to effectively lock said first lug piece against displacement along said first channel from each of said multiplicity of locations; and a first clamping piece mounted on said first lug piece for rotation about an axis normal to said plane of said upper surface of said table when said first lug piece is seated in said first channel, said first clamping piece having at least one projecting lobe portion with a bearing surface thereon disposed substantially at said plane of said table upper surface for being brought, by rotation of said first clamping piece, into clamping engagement with a workpiece supported against said back supporting surface of said fence member, when said first lug piece is seated in said first channel proximate to the workpiece.

2. The miter box of claim 1 wherein each of said structural elements has an apex and is symmetrical about a centerline extending through said apex perpendicular to said center line of said first channel.

3. The miter box of claim 2 wherein said structural elements of one of said shaped sidewalls defining said first channel are offset, along the length of said first channel, from like structural elements of the other of said shaped sidewalls a distance less than the distance between the apices of adjacent structural elements on said sidewalls, and wherein said mating structural features on said opposite lateral surfaces of said first lug piece have substantially the same relative offset as do said sidewall structural elements, said first lug piece thereby being constructed to seat engagingly in said first channel in both of the end-for-end inverted orientations thereof, such inversion shifting the position of said lirst lug piece, relative to any position attainable by said first lug piece in its non-inverted orientation, along the length of said first channel.

4. The miter box of claim 1 wherein said shape of said sidewalls of said first channel is of undulant, sawtooth, or square tooth character.

5. The miter box of claim 1 wherein said first channel extends along a substantially rectilinear axis.

6. The miter box of claim 5 wherein said rectilinear axis is generally normal to said plane of said back supporting surface of said fence member.

7. The miter box of claim 1 wherein said first clamping piece has two opposite end portions, each providing a projecting lobe portion having a said bearing surface so disposed thereon, and wherein said first clamping piece and said first lug piece have means for coupling them for relative rotation about an axis that is eccentric to a midpoint between said bearing surfaces of said first clamping piece.

8. The miter box of claim 7 wherein said means for coupling comprises a pin projecting from one of said first pieces and an aperture formed in the other of said first pieces dimensioned to receive said pin, at least one of said pin and said aperture being disposed on said eccentric axis of said first clamping piece.

9. The miter box of claim 1 wherein said channel-defining means defines a second channel like said first channel, and wherein said miter box additionally includes a second said lug piece and a second said clamping piece, said second channel, said second lug piece, and said second clamping piece functioning cooperatively with one another in the manner defined in respect of said first channel, said first lug piece, and said first clamping piece.

* * * * *